United States Patent [19]

Thumm

[11] 4,009,643

[45] Mar. 1, 1977

[54] HYDRAULIC MOTOR FOR ROTATING THE BUCKET OF AN EXCAVATING MACHINE

[76] Inventor: Heinz Thumm, Benzstrasse 9, D-7013 Oeffingen, Germany

[22] Filed: Feb. 26, 1975

[21] Appl. No.: 553,108

[52] U.S. Cl. ..... 91/492; 214/147 G

[51] Int. Cl.[2] ..... F01B 13/06; B66C 3/02; B66C 3/16

[58] Field of Search ..... 91/491, 492, 503; 214/147 G, 656, 657, 658

[56] References Cited

UNITED STATES PATENTS

| | | | |
|---|---|---|---|
| 3,413,029 | 11/1968 | Donovan | 214/656 |
| 3,586,052 | 6/1971 | Abe | 91/484 |
| 3,596,569 | 8/1971 | Wisbey | 91/503 |
| 3,633,773 | 1/1972 | Billings | 214/657 |
| 3,824,899 | 7/1974 | Dzioba | 91/491 |

FOREIGN PATENTS OR APPLICATIONS

| | | | |
|---|---|---|---|
| 1,528,498 | 4/1970 | Germany | 91/491 |
| 1,947,585 | 6/1970 | Germany | 91/491 |
| 1,816,070 | 12/1968 | Germany | 60/483 |
| 1,217,525 | 12/1970 | United Kingdom | 91/492 |
| 195,990 | 11/1967 | U.S.S.R. | 91/491 |

*Primary Examiner*—William L. Freeh
*Attorney, Agent, or Firm*—Hans Berman

[57] ABSTRACT

The clam-shell bucket of an excavating machine is rotatably connected with the arm or boom of the machine by a hydraulic motor which also provides passages for transmitting pressure fluid from the body of the machine to jacks opening and closing the bucket. Radial cylinder bores in the stator of the motor contain respective pistons and spherical cam followers which engage a radially undulating cam face of the rotor when sequentially supplied with hydraulic fluid by a distributor rotating with the rotor in an axial bore of the stator. The passages for the fluid supply of the bucket jacks extend partly in the rotor and partly in the stator and communicate through a bearing interface remote from the distributor and the axial bore containing the same.

10 Claims, 4 Drawing Figures

HYDRAULIC MOTOR FOR ROTATING THE BUCKET OF AN EXCAVATING MACHINE

This invention relates to hydraulic motors, and more particularly to a hydraulic motor which also serves as a rotary coupling between hydraulic lines respectively connected to the rotor and the stator of the motor for operating other equipment.

In its more specific aspects, the invention will be described hereinbelow with reference to the hydraulic system of an excavating machine in which the hydraulic motor rotatably connects the clam-shell bucket of the excavating machine with a supporting arm or boom, and simultaneously provides a coupling for hydraulic lines supplying another hydraulic motor for operating the bucket.

The hydraulic motor is of the type in which the rotor and stator movably engage each other in an interface of circular cross section about a common axis, the stator is formed with a plurality of radial cylinder bores and an axial bore in which each of the cylinder bores has an orifice. A piston and an engagement member of circular cross section, such as a bearing ball, are received in each cylinder bore, and the engagement member engages a cam face of the rotor radially undulating in a closed loop about the motor axis when the cylinder bores are sequentially supplied with hydraulic fluid by a distributor connected to the rotor for joint rotation in the axial bore.

To provide a rotatable coupling between a source of hydraulic fluid on the body of the excavating machine and another hydraulic motor which can open and close the bucket, a known motor of this type is provided with a duct in the distributor communicating with a corresponding duct in the stator. This known arrangement is relatively complex, requires a multiplicity of sealed movable connections between pressure lines, and can be assembled only from a relatively large number of individual parts whose dimensions are critical. The distributor of the known hydraulic motor is relatively large in diameter and must be mounted in the associated stator bore in a close fit with negligible clearances which are relatively costly to establish and to maintain.

It is an important object of this invention to provide a hydraulic motor of the general type described above and suitable for the application more specifically described which consists of relatively few, readily shaped individual parts, is simple in its construction, and easy to maintain because of slow wear of moving parts.

With this object and others in view, as will hereinafter become apparent, the invention provides a hydraulic motor in which the two principal motor members, that is, the stator and rotor, movably engage each other in an interface of circular cross section about the common axis, and the passages for flow of fluid to and from another motor are remote from the axial bore of one motor member in which the distributor is received, and extend between communicating recesses of the two motor members in their bearing interface and accessible ports on the two motor members.

Other features and many of the attendant advantages of this invention will readily be appreciated as the same becomes better understood by reference to the following detailed description of preferred embodiments when considered in connection with the appended drawing in which.

Figure 1:
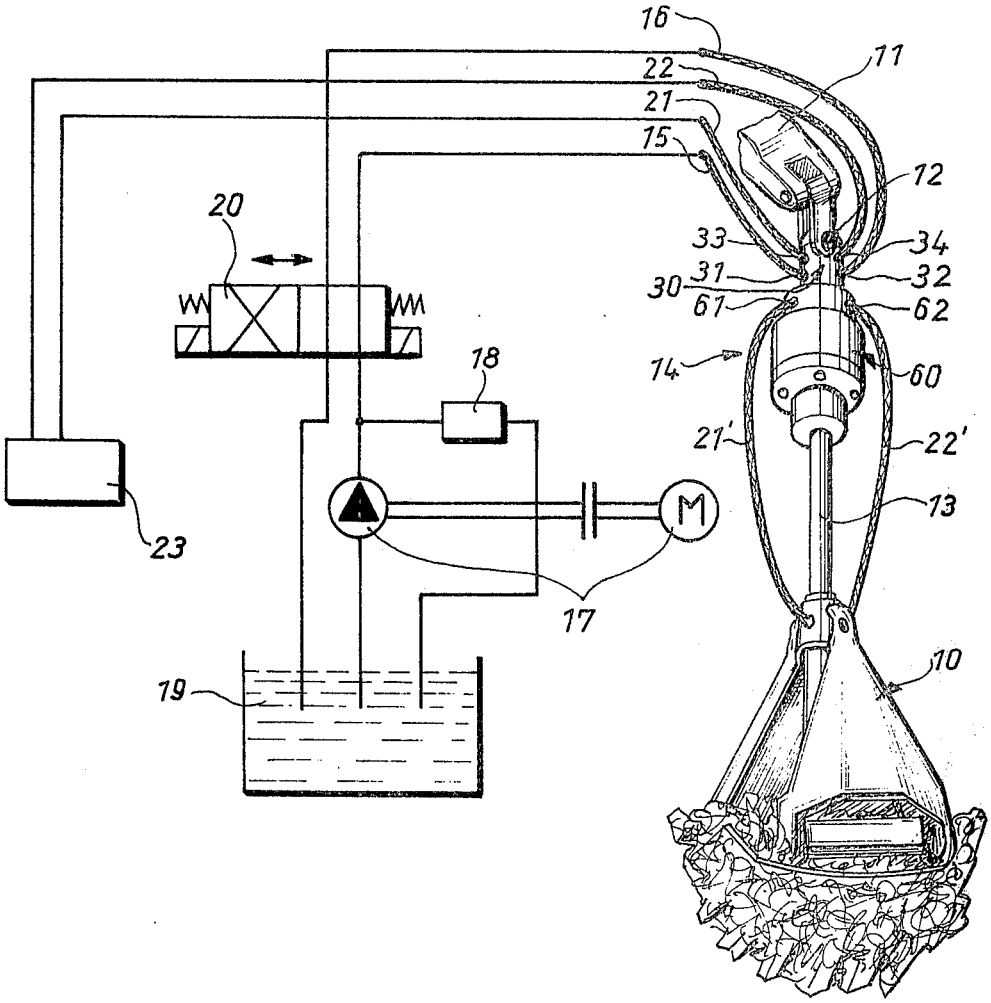
FIG. 1 shows an excavating machine equipped with a hydraulic motor of the invention in a fragmentary perspective view, portions of the associated hydraulic supply and control circuit being represented by conventional symbols.

Referring now to the drawing in detail, and initially to FIG. 1, there is shown only as much of an excavating machine, conventional as far as not illustrated, as is needed for an understanding of the invention. The partly illustrated arm or boom 11 of the machine is mounted on a vehicular base (not shown) and is connected by a universal joint 12 to the stator 30 of a hydraulic motor 14. The rotor 60 of the motor 14 has an output shaft 13 carrying a bucket 10 of the clam-shell type. Pressure lines 15, 16 connect a first set of ports 31, 32 on the stator 30 with a reversing valve 20. Hydraulic pressure fluid is drawn by a motor-driven pump 17 from a sump 19 and supplied to the valve 20 at a pressure held constant by a pressure-relief valve 18 in a conventional manner. In the illustrated position of the valve 20, pressure fluid is supplied by the pressure line 15 to the port 31, and fluid is returned from the port 32 through the line 16 to the sump, the pump 17, valves 18, 20, and sump 19 being mounted on the non-illustrated vehicular base of the machine.

The non-illustrated hydraulic motor which operates the bucket 10 is supplied with hydraulic fluid by a hydraulic circuit 23, not relevant to this invention and conventional in itself, which may consist of a separate motor-driven pump, a relief valve, and a reversing valve or may have elements in common with the hydraulic circuit of the motor 14. To avoid tangling of hydraulic lines during rotation of the shaft 13, the bucket motor receives and discharges hydraulic fluid through a coupling arrangement built into the motor 14. For this purpose, the stator 30 is provided with two ports 33, 34 from which pressure lines 21, 22 lead to the hydraulic circuit 23, and two ports 61, 62 accessible on the rotor 60 are connected with hydraulic lines 21', 22' leading to the bucket 10. The second set of ports 33, 34, 61, 62 is unrelated to the driving function of the motor 14.

Figure 2:
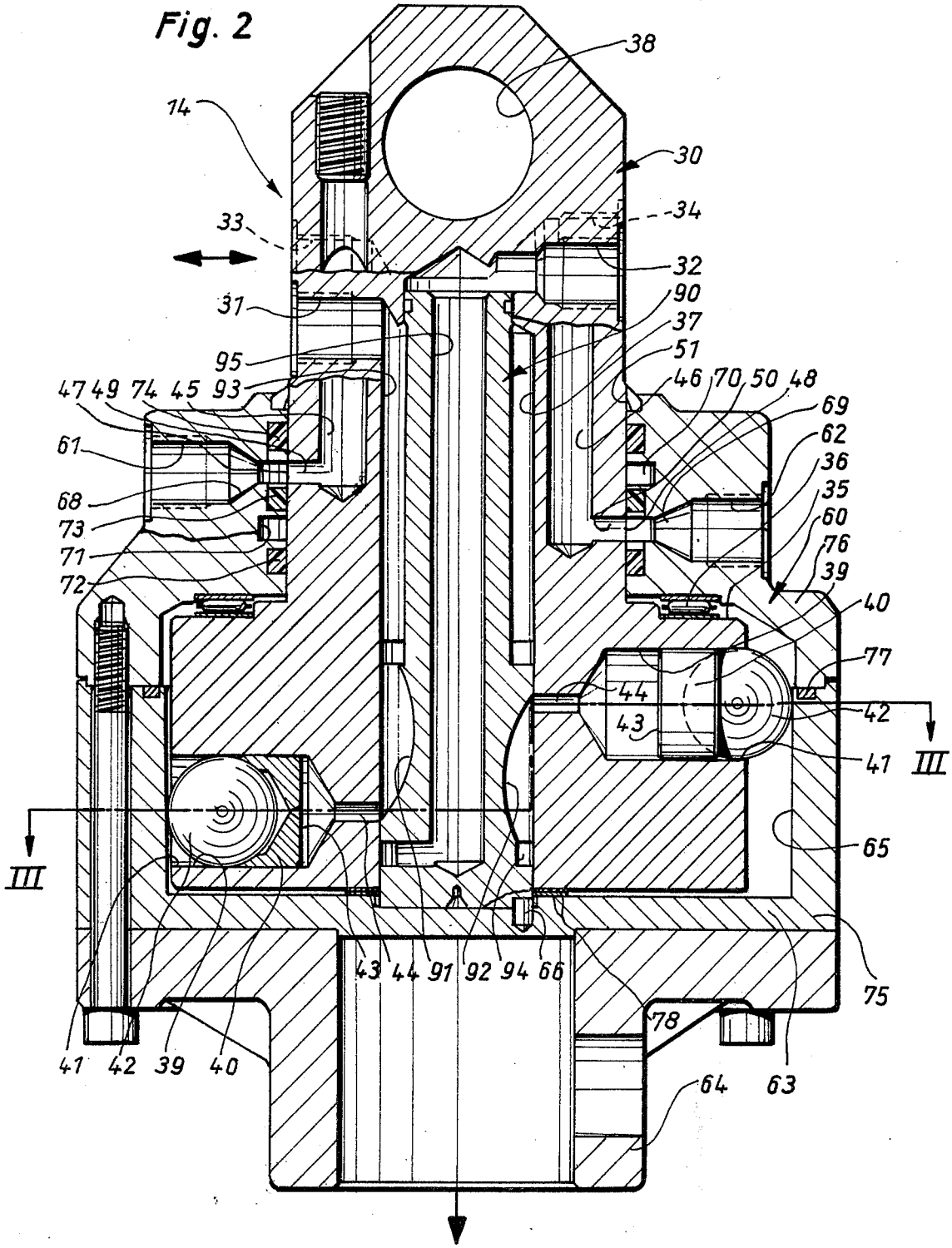
FIG. 2 shows the motor of FIG. 1 in axial section on the line II — II in FIG. 3.

As is shown in FIG. 2, the stator 30 has a radial shoulder 35 carrying an annular roller bearing 36 on which the rotor 60 is suspended. A central, axial bore 37 of the stator 30 rotatably receives a distributor 90. A heavy mounting lug of the stator 30 has an opening 38 by means of which it is attached to the universal joint 12 not itself shown in FIG. 2. The output shaft 13 of the motor, omitted from FIG. 2, is fastened to the radial bottom wall 63 of the rotor 60 by means of a flange 64.

Eight radial cylinder bores 39 are arranged equiangularly about the axis of motor rotation in the stator 30 on two axial levels. Each cylinder bore receives a piston 40 which backs a spherical engagement member or cam follower 42. A narrow inner orifice 44 of each bore 39 communicates with the axial bore 37 for admitting pressure fluid to the piston face 43, as will presently be described.

Figure 3:
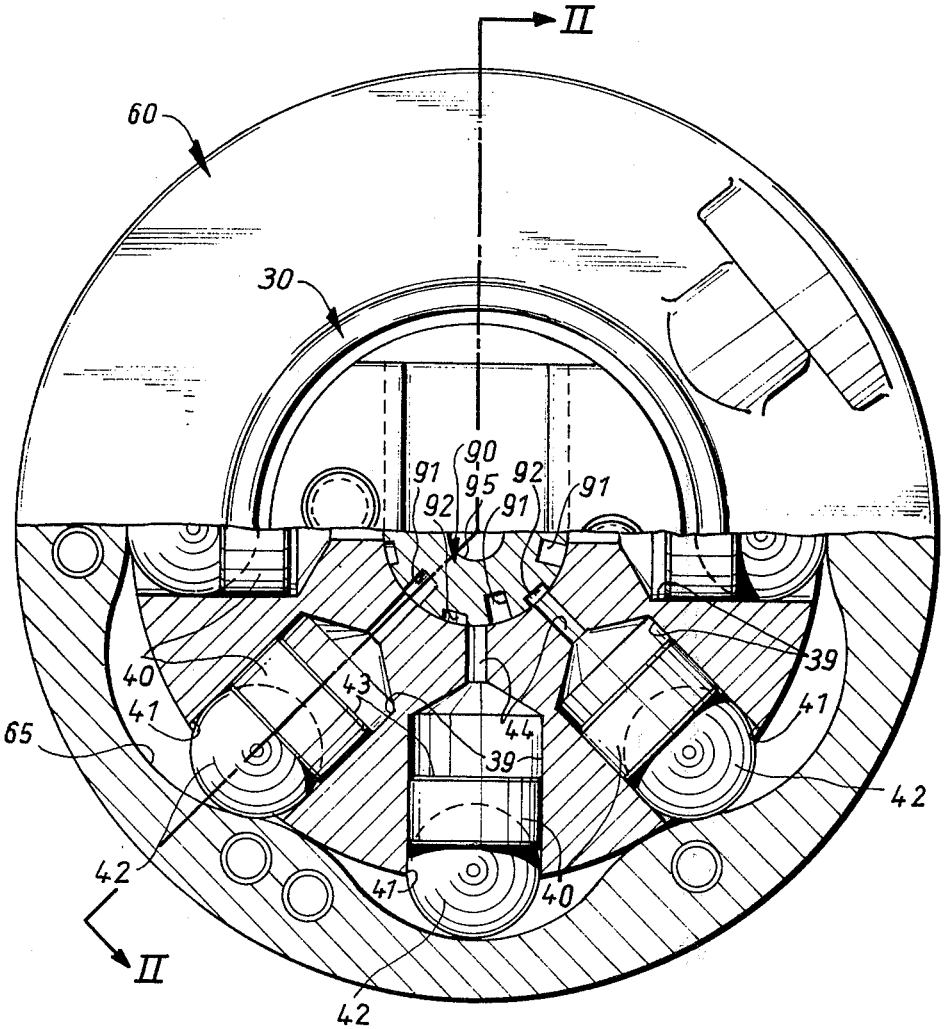
FIG. 3 illustrates the motor of FIG. 2 in section on the line III — III.

As is best seen in FIG. 3, the cam followers 42 travel over a cam face 65 on the rotor 60 during operation of the motor 14. The cam face 65 extends in a closed loop about the motor axis and undulates radially so as to have six radially projecting lobes. A cam follower member 42 pressed against the slope of a cam lobe through the wide outer orifice 41 of the associated bore 39 exerts torque on the rotor 60. For continuous operation of the motor 14, the several cylinder bores 39 are provided with pressure fluid in the proper sequence by the distributor 90 which also vents those cylinder bores from which fluid needs to be returned to the sump 19.

The distributor 90 is a unitary piece of metal machined from cylindrical bar stock. A coupling pin 66 excentrically received in the bottom wall 63 and in a radially open notch in the bottom face of the distributor 90 connects the distributor to the rotor 60 for joint rotation while permitting limited axial and radial movement of the distributor 90 in the bore 37. Axial slots 91, 92 are formed in the outer surface of the distributor 90 in circumferentially alternating relationship. The grinding wheel employed in making the slots accounts for the arcuate shape of their inner axial walls. The slots 91 are axially offset from the slots 92 and communicate through an annular, axially elongated, connecting conduit 93 defined between the wall of the stator 30 in the bore 37 and a cylindrical outer surface of the distributor 90 with the port 31 in all angular positions of the distributor 90. The slots 92 are similarly connected to the port 32 by a central, axial, connecting conduit 95 in the distributor 90 and an annular groove 94 in the outer face of the distributor 90 which intersects each slot 92.

The necessary radial alignment of the 12 slots 91, 92 with respective slopes of the six lobes in the cam face 65 which is required for continuous operation of the motor in both directions will be evident to those skilled in the art and may be deduced from FIG. 3.

The ports 33, 34 on the stator 30 are connected with respective ports 61, 62 on the rotor 60 by separate passages remote from the axial bore 37 and the distributor 90 received therein. Axial bores 45, 46 in the stator 30 lead from the ports 33, 34 to radial stator bores 49, 50 which terminate in circular recesses in the cylindrical bearing interface 51 of the stator 30 and the rotor 60. The ports 61, 62 on the rotor 60 lead into tapering radial bores 68, 69 of the stator and ultimately into axially offset annular grooves 70, 71 which form recesses in the interface 51 on the rotor side. Liquid can thus flow through junctions 47, 48 between the grooves 70, 71 and the orifices of the bores 49, 50 in all angular positions of the stator 30 and the rotor 60. Sealing rings 72, 73, 74 prevent flow of hydraulic fluid between the two passages and outward of the passages along the bearing interface 51.

As is evident from inspection of FIG. 2, the combined hydraulic motor and rotary pressure line coupling 14 consists of only a few parts which are readily shaped by machining. The general contours of the stator 30 are formed from a unitary piece of metal on a lathe, and the several bores are drilled and may thereafter be plugged where axial bores, such as the bore 45, have to be drilled from a surface in which they should not have open orifices. The distributor 90 is shaped from a unitary piece of cylindrical bar stock in an obvious manner partly described above, and the rotor 60 basically consists of a cup-shaped element 75 and an annular element 76 of stepped cylindrical shape which are connected by screws in a butt joint 77. During assembly of the motor 14, annular discs 78 are slipped over the distributor 90 before the distributor is set on the rotor element 75 and before the stator 30 is inserted in the cavity of the element 75. The discs provide a sliding bearing when the bucket 10 hangs from the arm 11, and function as a thrust bearing when the bucket is pressed against the ground by the arm 11.

Because the distributor 90 is permitted by the coupling 66 to float axially and radially in the bore 37 to some extent, the movingly engaged surfaces of the distributor and of the stator 30 are subject to much less wear than would occur with a rigid connection between the rotor 60 and the distributor.

Figure 4:
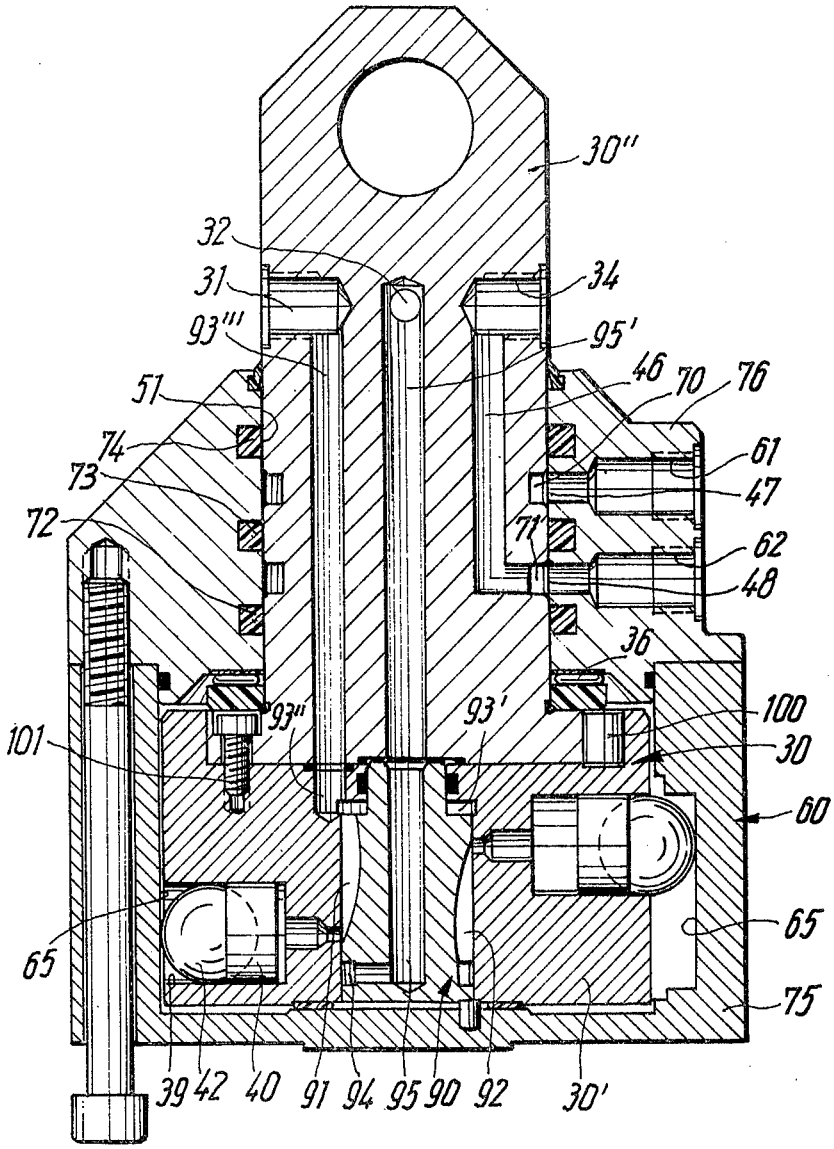
FIG. 4 shows a modified motor of the invention in a view corresponding to that of FIG. 2.

The modified motor shown in FIG. 4 has many elements in common with the first-described embodiment illustrated in FIGS. 2 and 3, and its description will be limited to those features by which the apparatus of FIG. 4 differs from that of FIG. 2.

The stator shown in FIG. 4 consists of two elements 30′,30″ respectively corresponding to two axial portions of the stator 30. The shortened distributor 90 is confined rotatably in a central axial bore of the lower stator part 30′, and its central connecting conduit 95 communicates with the port 32 through an aligned bore 95′ in the stator part 30″. The annular groove 93′ which connects the slots 91 in the distributor 90 is connected with the port 31 by a bore 93″ in the stator part 30′ and an aligned axial bore 93‴ in the stator part 30″.

The stator part 30′ is preferably a steel casting, whereas the stator part 30″ is machined from steel having high notched-bar impact strength. Circumferentially distributed grooves in axially coextensive, otherwise cylindrical faces of the stator parts 31′, 31″ about the motor axis receive hollow steel pins 100 whose axes are parallel to the motor axis. The pins 100 are capable of resilient deformation in a circumferential direction and connect the two stator parts for joint rotation. The stator parts are axially secured to each other by screws 101 of which only one is seen in FIG. 4.

Because the passages connecting the second ports 33, 34, 61, 62 in the motors of the invention are spaced apart from the distributor 90 and the stator bore 37 receiving the distributor, the passages are located farther from the motor axis than in the known motor in which the distributor accommodates portions of the passages. This is hardly a disadvantage in view of the low rotary speed at which a motor of the type described is normally operated so that centrifugal forces are negligibly small. The arrangement of the invention permits the motor to be built at relatively small expense and to be maintained in operating condition with much less work than was necessary in the older design.

The surfaces of the distributor and of the stator which are subject to wear in the motor of the invention are axially short because of the conduit 93 provided in the embodiment shown in FIG. 2 and the small overall length of the distributor in the modified embodiment illustrated in FIG. 4. The radial contact pressure between the distributor and the stator is reduced by the floating connection provided by the coupling pin 66 in both embodiments. The hydraulic fluid effectively lubricates the engaged surfaces of the distributor and of the stator. The annular discs 78 prevent contact of stator and rotor under the weight of the suspended bucket and the resulting wear.

The use of different materials of construction in the two stator parts 30′, 30″ shown in FIG. 4 is preferred where unusually severe working conditions are to be expected. The high-strength material of the stator part 30″ maintains its dimensions unchanged over long periods under unfavorable conditions and thereby prevents leakage from the passages for the operating fluid of the bucket motor. The stator portion 32'' which is subject to more rapid wear than the portion 31' may thus be replaced while retaining the portion 31''. Failure of the motor material under circumferential inertial stresses caused during the pivoting of heavy loads is prevented under all but extreme conditions by the resiliently deformable hollow steel pins 100 which reversibly absorb peak loads.

While elements 30, 60 were referred to respectively in this specification as the stator and the rotor of the motor 14, the motor is capable of being installed in the reversed condition with minor alterations that will readily suggest themselves to those skilled in the art. Either principal motor member may be mounted in such a manner as to be prevented from rotation about the motor axis, as the stator 30 is prevented from rotating in the illustrated embodiments of the invention by the joint 12.

It should be understood, therefore, that the foregoing disclosure relates only to preferred embodiments of the invention, and that it is intended to cover all changes and modifications of the examples of the invention herein chosen for the purpose of the disclosure which do not constitute departures from the spirit and scope of the invention set forth in the appended claims.

What is claimed is:

1. A hydraulic motor comprising:

a. a first motor member and a second motor member movably engaging each other in an interface of circular cross section about a common axis,
   1. said first member being formed with a plurality of radial cylinder bores and an axial bore remote from said interface, each cylinder bore having an orifice in said axial bore,
   2. each cylinder bore receiving piston means including a cam follower,
   3. the other member having a radially undulating cam face extending about said axis in a closed loop,
   4. each cam follower engaging said cam face when pressure fluid is admitted to the associated cylinder bore while said motor members move relative to each other about said axis;

b. a distributor member rotatably received in said axial bore and defining two connecting conduits sequentially communicating with said orifices during rotation of said distributor member in said axial bore; and c. coupling means coupling said distributor member to said second motor member for joint rotation about said axis while permitting limited radial and axial movement of said distributor member relative to said second motor member,
   1. one of said motor members being formed with two first accessible ports permanently communicating with said two connecting conduits respectively,
   2. each of said motor members being formed with two second accessible ports, two recesses in said interface, and two ducts respectively connecting said second ports to said recesses,
   3. each of said recesses permanently communicating with a corresponding recess in the other motor member in such a manner that said ducts and said recesses constitute two separate passages connecting the second ports of said first motor member to the second ports of said second motor member respectively.

2. A motor as set forth in claim 1, wherein respective wall portions of said distributor member and of said first motor member in said axial bore define a portion of one of said connecting conduits, said portion being annular about said axis and axially elongated.

3. A motor as set forth in claim 1, wherein said distributor member is a unitary body of solid material.

4. A motor as set forth in claim 1, wherein said interface is cylindrical about said axis.

5. A hydraulic motor comprising:

a. a first motor member and a second motor member movably engaging each other in an interface of circular cross section about a common axis,
   1. said first member being formed with a plurality of radial cylinder bores and an axial bore remote from said interface, each cylinder bore having an orifice in said axial bore,
   2. each cylinder bore receiving piston means including a cam follower,
   3. the other member having a radially undulating cam face extending about said axis in a closed loop,
   4. each cam follower engaging said cam face when pressure fluid is admitted to the associated cylinder bore while said motor members move relative to each other about said axis;

b. a distributor member rotatably received in said axial bore and defining two connecting conduits sequentially communicating with said orifices during rotation of said distributor member in said axial bore;

c. coupling means coupling said distributor member to said second motor member for joint rotation about said axis,
   1. one of said motor members being formed with two first accessible ports permanently communicating with said two connecting conduits respectively,
   2. each of said motor members being formed with two second accessible ports, two recesses in said interface, and two ducts respectively connecting said second ports to said recesses,
   3. each of said recesses permanently communicating with a corresponding recess in the other motor member in such a manner that said ducts and said recesses constitute two separate passages connecting the second ports of said first motor member to the second ports of said second motor member respectively; and d. a thrust bearing axially interposed between said motor member.

6. A motor as set forth in claim 5, wherein said cylinder bores and said axial bore are formed in a unitary portion of said first motor member, said second motor member including two unitary portions fixedly secured to each other and jointly enveloping said portion of said first motor member.

7. A hydraulic motor comprising:

a. a first motor member and a second motor member movably engaging each other in an interface of circular cross section about a common axis,
   1. said first member including two metallic parts and fastening means fastening said two parts to each other,
   2. one of said parts being formed with a plurality of radial cylinder bores and an axial bore remote from said interface, each cylinder bore having an orifice in said axial bore, 3. each cylinder bore receiving piston means including a cam follower, 4. the other motor member having a radially undulating cam face extending about said axis in a closed loop, 5. each cam follower engaging said cam face when pressure fluid is admitted to the associated cylinder bore while said motor members move relative to each other about said axis;

b. a distributor member rotatably received in said axial bore and defining two connecting conduits sequentially communicating with said orifices during rotation of said distributor member in said axial bore; and c. coupling means coupling said distributor member to said second motor member for joint rotation about said axis, 1. one of said motor members being formed with two first accessible ports permanently communicating with said two connecting conduits respectively, 2. each of said motor members being formed with two second accessible ports, two recesses in said interface, and two ducts respectively connecting said second ports to said recesses, 3. each of said recesses permanently communicating with a corresponding recess in the other motor member in such a manner that said ducts and said recesses constitute two separate passages connecting the second ports of said first motor member to the second ports of said second motor member respectively, 4. the recesses in said first motor member being formed in the other metallic part of said first motor member, 5. said other part consisting of a metal having higher notched-bar impact resistance than the metal of said one part.

8. A motor as set forth in claim 7, wherein said fastening means include resiliently deformable connecting elements circumferentially connecting said two parts for joint rotation.

9. A motor as set forth in claim 8, wherein said connecting elements are hollow pins having each an axis parallel to said common axis.

10. A hydraulic motor comprising:

a. a first motor member and a second motor member movably engaging each other in an interface of circular cross section about a common axis, 1. said first member being formed with a plurality of radial cylinder bores and an axial bore remote from said interface, each cylinder bore having an orifice in said axial bore, 2. each cylinder bore receiving piston means including a cam follower, 3. the other member having a radially undulating cam face extending about said axis in a closed loop, 4. each cam follower engaging said cam face when pressure fluid is admitted to the associated cylinder bore while said motor members move relative to each other about said axis;

b. a distributor member rotatably received in said axial bore and defining two connecting conduits sequentially communicating with said orifices during rotation of said distributor member in said axial bore;

c. coupling means coupling said distributor member to said second motor member for joint rotation about said axis, 1. one of said motor members being formed with two first accessible ports permanently communicating with said two connecting conduits respectively, 2. each of said motor members being formed with two second accessible ports, two recesses in said interface, and two ducts respectively connecting said second ports to said recesses, 3. each of said recesses permanently communicating with a corresponding recess in the other motor member in such a manner that said ducts and said recesses constitute two separate passages connecting the second ports of said first motor member to the second ports of said second motor member respectively; and d. means for preventing rotation of said first motor member about said axis when hydraulic fluid under pressure is supplied to one of said first ports and said fluid is released from the other port.

* * * * *